US006778162B2

(12) United States Patent
Kimura et al.

(10) Patent No.: US 6,778,162 B2
(45) **Date of Patent: *Aug. 17, 2004**

(54) DISPLAY APPARATUS HAVING DIGITAL MEMORY CELL IN PIXEL AND METHOD OF DRIVING THE SAME

(75) Inventors: Hiroyuki Kimura, Saitama-ken (JP); Takashi Maeda, Saitama-ken (JP); Takanori Tsunashima, Saitama-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/996,742

(22) Filed: Nov. 30, 2001

(65) Prior Publication Data

US 2002/0075205 A1 Jun. 20, 2002

(30) Foreign Application Priority Data

Nov. 30, 2000 (JP) ..... 2000-365426
Nov. 16, 2001 (JP) ..... 2001-351795

(51) Int. Cl.[7] ..... G09G 3/36

(52) U.S. Cl. ..... 345/90; 345/98; 345/92; 345/55

(58) Field of Search ..... 345/55, 87, 90, 345/92, 93, 96, 98, 99, 100, 208, 211–214, 530–532, 534; 349/41, 143

(56) References Cited

U.S. PATENT DOCUMENTS

| | | | | |
|---|---|---|---|---|
| 5,712,652 A | | 1/1998 | Sato et al. | |
| 5,798,746 A | * | 8/1998 | Koyama | 345/98 |
| 5,945,972 A | * | 8/1999 | Okumura et al. | 345/98 |
| 6,064,362 A | * | 5/2000 | Brownlow et al. | 345/98 |
| 6,115,017 A | * | 9/2000 | Mikami et al. | 345/92 |
| 6,456,267 B1 | * | 9/2002 | Sato et al. | 345/92 |

* cited by examiner

*Primary Examiner*—Henry N. Tran
(74) *Attorney, Agent, or Firm*—Oblon, Spivak, McClelland, Maier & Neustadt, P.C.

(57) ABSTRACT

Disclosed is a circuit constitution of a display apparatus comprising a digital memory (DM) cell for each pixel. The DM cell is composed of one inverter circuit, and a DM switching circuit for controlling an electrical conduction between a pixel electrode and the DM cell is provided. During a normal displaying period, the DM cell and the pixel electrode are not electrically conducted by the DM switching circuit, and a full-color image displaying is performed by dynamic image data supplied to a signal line. During a still image displaying, the DM cell and the pixel electrode are electrically conducted by the DM switching circuit, and a multi-color image displaying is performed by still image data retained in the DM cell.

21 Claims, 8 Drawing Sheets

DISPLAY APPARATUS HAVING DIGITAL MEMORY CELL IN PIXEL AND METHOD OF DRIVING THE SAME

CROSS-REFERENCE TO RELATED APPLICATIONS

This application is based upon and claims the benefit of priority under 35USC &119 to Japanese Patent Application No. 2000-365426, filed Nov. 30, 2000 and No. 2001-351795, filed Nov. 16, 2001; the entire contents of which are incorporated herein by reference.

BACKGROUND OF THE INVENTION

1. Field of the Invention

The present invention relates to a display apparatus used as a display incorporated in a cellular phone, an electronic book and the like. More specifically, the present invention relates to an active matrix type display apparatus incorporating a digital memory cell in a pixel, and to a method of driving the same.

2. Description of the Related Art

Liquid crystal display apparatus has been used as a display of a portable information terminal while utilizing advantages of a light weight, a thin thickness and low power consumption. Since such a portable information terminal generally adopts a battery-driven type, low power consumption is an important subject for it. Particularly, cellular telephones are required to be capable of displaying with low power consumption during a standby period.

As a technology to realize the displaying with the low power consumption, disclosed are active matrix type liquid crystal display apparatuses incorporating digital memory cells (DM cells) (hereinafter referred to as a liquid crystal display apparatus incorporating DM cells) as a storage device which is capable of storing video data statically in one pixel. There is U.S. Pat. No. 5,712,652 as a document disclosing such a kind of liquid crystal display apparatus incorporating DM cells. In the image display apparatus disclosed in this gazette, only circuits for AC-driving the liquid crystal by binary data stored in the DM cells are operated during a standby period (still image displaying period), and peripheral driving circuits other than these circuits are stopped to operate, whereby power consumption can be significantly decreased.

Incidentally, in the conventional liquid crystal display apparatuses incorporating DM cells, SRAMs are used as the DM cells. Each of these SRAMs is usually constituted by five transistors. Therefore, to dispose the DM cells on a substrate, an area having a size to some extent is required, and hence microfabrication of the liquid crystal display apparatus is difficult.

BRIEF SUMMARY OF THE INVENTION

An object of the invention is to realize a microfabrication of a pixel in a display apparatus incorporating DM cells.

A display apparatus according to the present invention including a first electrode substrate having a plurality of scan lines and a plurality of signal lines arranged so as to intersect with each other, pixel electrodes, each being arranged at corresponding one of crossing points of the scanning and signal lines, first capacitor elements, each being electrically in parallel connected to corresponding one of the pixel electrodes, and first switching elements, each being turned ON/OFF by a row selection signal supplied to the corresponding one of the scan lines, and when turned ON, allowing the signal line and the pixel electrode to be electrically conducted, thus writing video data supplied to the signal line to the pixel electrode, a second electrode substrate having opposite electrodes, oppositely disposed so as to face the said pixel electrodes with a predetermined gap therebetween, a display layer sandwiched between the first and second electrode substrates, a data driver for supplying the video data to the plurality of signal lines in response to one horizontal scanning period and a scan driver circuit for sequentially supplying the row selection signal to the corresponding one of the scan lines every the one horizontal scanning period, wherein the first electrode substrate has, a digital memory cell composed of one inverter circuit capable of retaining the video data supplied to the signal line, and a digital memory switching circuit for controlling an electrical conduction between the pixel electrode and the digital memory cell.

A method of driving the display apparatus has features in that during a first displaying period, the pixel electrode and the digital memory cell are not electrically conducted by the digital memory switching circuit, and the first switching element is turned on at a predetermined cycle, thus performing displaying by writing first video data supplied to the signal line to the pixel electrode, and during a second displaying period, the pixel electrode and the digital memory cell are electrically conducted by the digital memory switching circuit, the digital memory cell is allowed to retain second video data therein supplied to the signal lines, and then the signal lines and the pixel electrode are not electrically conducted by the first switching element, thus performing displaying by writing the second video data retained in the digital memory cell to the pixel electrode.

DETAILED DESCRIPTION OF THE INVENTION

Descriptions of a display apparatus and a method of driving the same according to the present invention will be made for an embodiment in which the present invention is applied to an active matrix type liquid crystal display apparatus and a method of driving the same.

Figure 1:
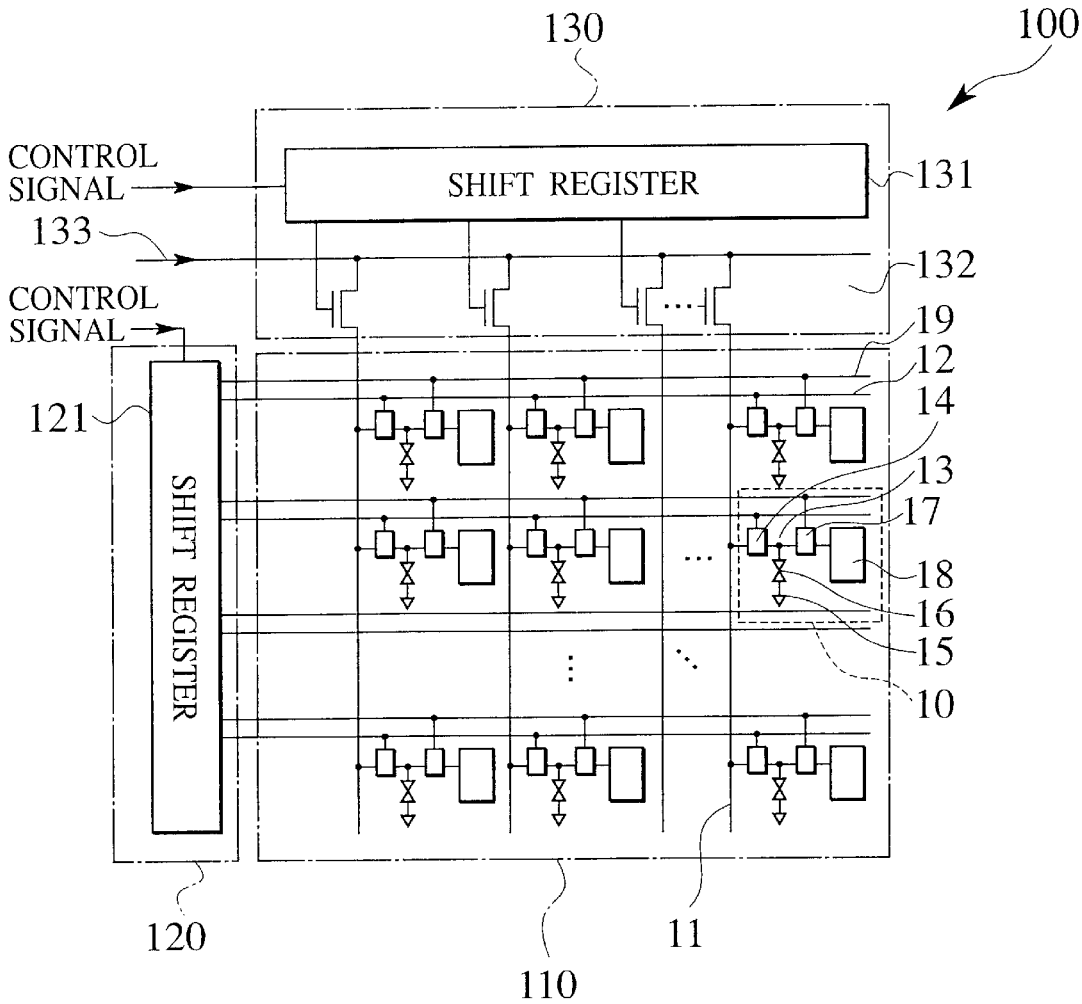
FIG. 1 is a circuit diagram of a liquid crystal display apparatus according to an embodiment.
Figure 2:
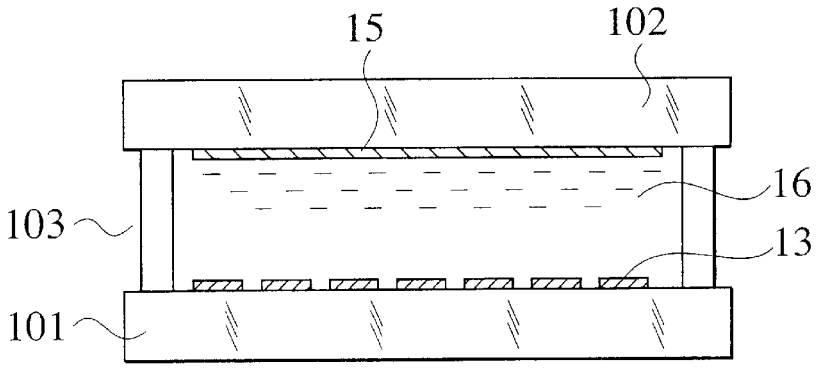
FIG. 2 is a schematic constitution view of FIG. 1.

FIG. 1 is a circuit diagram of the liquid crystal display apparatus 100 according to an embodiment of the present invention. FIG. 2 is a schematic section view of FIG. 1.

The liquid crystal display apparatus 100 is constituted by the display pixel section 110 in which a plurality of display pixels 10 are formed; a scan driver 120; and a data driver 130.

On the array substrate 101, the scan driver 120 and the data driver 130 of this embodiment are formed integrally with the later-described signal lines 11, the later-described scan lines 12 and the later-described pixel electrodes 13 and the like.

In the display pixel section 110, the plurality of signal lines 11 and the plurality of scan lines 12 which intersect the signal lines 11 are arranged so as to form a matrix on the array substrate 101 with an insulating film (not shown) interposed therebetween. The display pixels 10 are formed at the crossing points of both lines.

On the array substrate 101, the memory control signal lines 19 are arranged in parallel with the scan lines 12. A memory control signal is supplied from an external driving circuit (not shown) to each memory control signal line 19. In a later-described embodiment, there is a constitution example in which two memory control signal lines are arranged as the memory control signal lines 19*a* and 19*b*. Note that these two memory control signal lines are shown as the memory control signal line 19 to make the explanation simple in FIG. 1.

Each of the display pixels 10 is constituted by the pixel electrode 13; the first switching element 14; the opposite electrode 15; the liquid crystal layer 16; the DM switching circuit 17; and the DM cell 18. Note that the first capacitor element 24 is omitted to make the explanation simple in FIG. 1.

A source electrode of the first switching element 14 is connected to the corresponding signal line 11, a gate electrode thereof is connected to the corresponding scan line 12, and a drain electrode thereof is connected to the corresponding pixel electrode 13. Each of the pixel electrode 13 is connected to the corresponding one of the DM cells 18 through the DM switching circuit 17, and a gate electrode of the DM switching circuit 17 is connected to the corresponding memory control signal line 19. A source electrode of the DM switching circuit 17 is connected to the corresponding pixel electrode 13, and a drain electrode thereof is connected to the corresponding DM cell 18.

Each pixel electrode 13 is formed on the array substrate 101, and each opposite electrode 15 facing to the pixel electrode 13 is formed on the opposite substrate 102. A predetermined opposite electrode potential is applied to each opposite electrode 15 from the external driving circuit (not shown). The liquid crystal layer 16 is sandwiched as a display layer between the pixel electrode 13 and the opposite electrode 15. The liquid crystal capacitor Clc is formed for each display pixel 10. The sealing member 103 seals the peripheries of the array substrate 101 and the opposite substrate 102. Illustrations of an orientation film and a polarization plate are omitted in FIG. 2. Note that the array substrate 101 and the opposite substrate 102 are a first electrode substrate and a second electrode substrate in the embodiment, respectively.

The scan driver 120 is constituted by the shift register 121, a buffer circuit (not shown) and the like, and sequentially outputs a row selection signal to each scan line 12 at every one horizontal scanning period based on a control signal (vertical clock/start signal) supplied from the external driving circuit (not shown).

The scan driver 120 outputs the row selection signal onto each scan line 12 at every one horizontal scanning period during half tone displaying or dynamic image displaying (hereinafter referred to as "during normal displaying"). Furthermore, during still image displaying, the scan driver 120 stops to output the row selection signals to all of the scan lines 12.

The data driver 130 is constituted by the shift register 131, the analog switch (ASW) 132 and the like, and supplied with a control signal (horizontal clock/start signal) from the external driving circuit (not shown) and video data through the video bus 133. In the data driver 130, a turning ON/OFF signal is supplied to the ASW 132 from the shift register 131 based on the horizontal clock/start signal, whereby the video data supplied to the video bus 133 is sampled on each signal line 11 at predetermined timings.

In the following descriptions, video data for performing a half-tone displaying/dynamic image displaying by full-color image during a normal displaying period is called dynamic image data. In a still image displaying period, video data for performing a still image displaying by multi colors is called still image data. The video data for performing the still image displaying by the multi colors is video data having binary information. One display electrode 10 shown in FIG. 1 indicates sub-pixels displaying R (red), G (green) and B (blue), respectively. Accordingly, if it is assumed that one pixel as a displaying unit is constituted by the three sub-pixels R, G and B, multi-color displaying of eight colors ($2^3$) in total is possible.

The above-described normal displaying period and the above described still image displaying period are a first displaying period and a second displaying period in the respective embodiments. Furthermore, the dynamic image data and the still image data are a first video data and a second video data in the respective embodiments.

Herein, an operation in the case where the liquid crystal display apparatus 100 is driven as an ordinary active matrix type liquid crystal display apparatus will be described briefly.

When the row selection signal is output from the scan driver 120 at every one horizontal scanning period and the scan lines 12 are sequentially selected, all of the first switching elements 14 connected to the corresponding selected scan lines 12 are turned on only for one horizontal scanning period. When the dynamic image data is sampled onto each signal line 11 so as to synchronize with the turning ON of the first switching element 14, the dynamic image data sampled on the signal line 11 is written to the corresponding pixel electrode 13 through the first switching element 14. At this time, the liquid crystal layer 16 makes a response in accordance with a magnitude of charges of the dynamic image written to the pixel electrode 13, and thus an amount of transmission light from the display electrode is controlled. By carrying out such an operation for all scan lines 12 within one frame period, a pictorial image for one screen is completed. The dynamic image data written to each pixel electrode 13 is retained therein until new dynamic image data that has been subjected to a polarity inversion in a next frame is written thereto.

Next, the circuit constitution of the display pixel 10 will be described more in detail with reference to FIG. 3.

Figure 3:
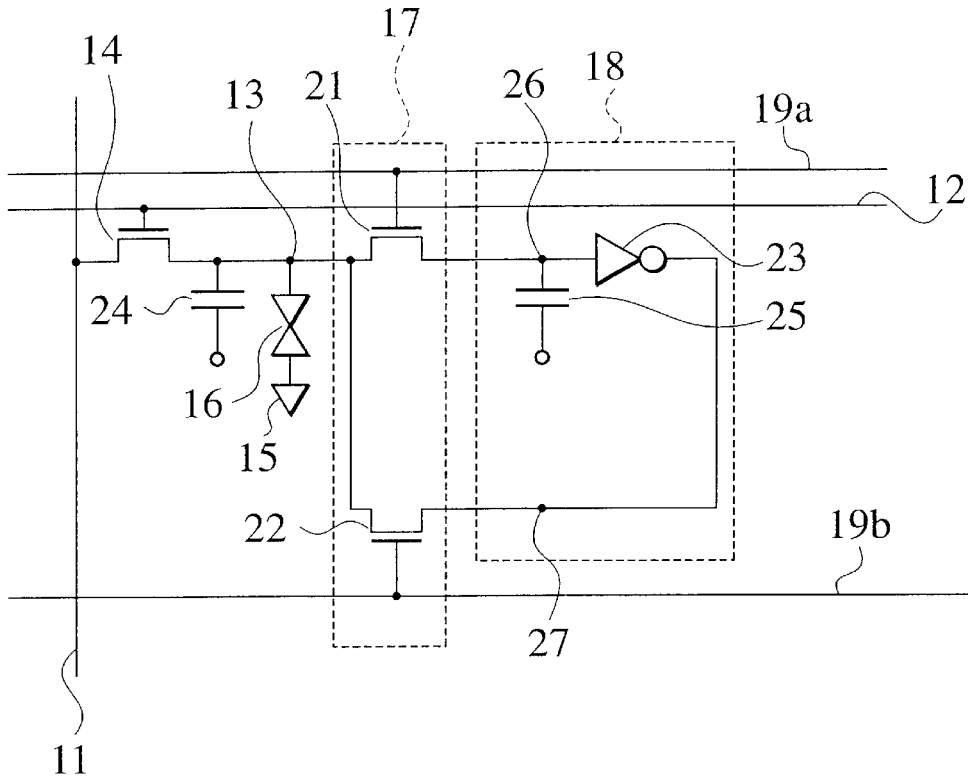
FIG. 3 is a circuit diagram of a display pixel shown in FIG. 1.

FIG. 3 is the circuit diagram of the display pixel 10 shown in FIG. 1. The pixel electrode 13 is connected to a drain electrode of the first switching element 14, and the first capacitor element 24, which is arranged electrically in parallel with the pixel electrode 13, is connected to the drain electrode of the first switching element 14. The first capacitor element 24 forms an auxiliary capacitor Cs between the pixel electrode 13 and an auxiliary capacitance line (not shown). A predetermined auxiliary capacitance voltage is applied from the external driving circuit (not shown) to the foregoing auxiliary capacitance line. The first capacitor element 24 is connected to the first switching element 14 so that the dynamic image data or the still image data written to the pixel electrode 13 is stably retained therein. The dynamic image data or the still image data written to the pixel electrode 13 is retained respectively in the liquid crystal capacitor Clc and the auxiliary capacitor Cs as charged charges.

Each of the DM switching circuits 17 is constituted by the second switching element 21 formed of an N-channel TFT and the third switching element 22 also formed of an N-channel TFT. Each of the DM switching circuits 17 is inserted between the pixel electrode 13 and the input and output terminals 26 and 27 of the DM cell 18. In the DM switching circuits 17, a gate electrode of the second switching element 21 is connected to the memory control signal line 19*a*, and a gate electrode of the third switching element 22 is connected to the memory control signal line 19*b*. Memory control signals respectively showing ON level and OFF level are supplied to the memory control signal lines 19*a* and 19*b* from the external driving circuit (not shown). Turning ON/OFF of the second and third switching elements 21 and 22 are independently controlled by the memory control signals. In this embodiment, the first switching element 14 and the DM switching circuit 17 are constituted by MOS transistors.

Note that the N-channel TFT constituting the second switching element 21 and the N-channel TFT constituting the third switching element 22 are field effect transistors of the same conductivity type in this embodiment.

The DM cell 18 is constituted by one inverter circuit 23 and the second capacitor element 25. The still image data written to the DM cell 18 in displaying the still image can be retained only by the inverter circuit 23. However, by connecting the second capacitor element 25 to the inverter circuit 23, the charged charges in the inverter circuit 23 can be retained more stably. Incidentally, when the DM cell 18 is constituted only by the inverter circuit 23, the still image data is retained by a wiring capacitance and a capacitance component of the inverter itself.

A positive power source wiring (not shown) and a negative power source wiring (not shown) are respectively connected to the positive polarity side of the inverter circuit 23 and the negative polarity side thereof. A DC High power source voltage and a DC Low power source voltage are respectively supplied thereto from a power source voltage generation circuit (not shown).

In this embodiment, as shown in FIG. 3, the DM cell 18 is constituted by one inverter circuit 23 and the second capacitor element 25. Therefore, the number of transistors in the DM cell which has required five transistors can be decreased to two transistors for the inverter circuit and one capacitor element. Furthermore, when the DM cell 18 is constituted only by one inverter circuit 23, the number of transistors of the DM cell can be decreased to two transistors. Accordingly, by adopting the circuit constitution as described above, an arrangement area of the DM cell 18 on the substrate can be made to be small, and hence microfabrication of the pixel can be realized. Furthermore, if the microfabrication of the processes advances, several pixels can be integrated to one pixel as a display unit, so that gradation displaying can be made possible in displaying the still image.

When the second switching element 21 alone is allowed to be turned on and the display pixel 10 is driven so that the first and second capacitor elements 24 and 25 are electrically conducted, the charges of the dynamic data written to the pixel electrode 13 can be partially retained in the second capacitor element 25. Accordingly, when a capacitance required in the normal driving is formed by combining a capacitance of the first capacitor element 24 and capacitance of the second capacitor element 25, the capacitance of the first capacitor element 24 can be made smaller by an amount equal to the capacitance of the second capacitor element 25. According to such a constitution, a circuit area on the substrate can be made small, and microfabrication and an increase in a manufacturing yield can be realized.

Next, a method of driving the liquid crystal display apparatus 100 in a normal displaying and a still image displaying, which is constituted as described above, will be described.

First, in the normal displaying, the memory control signal line 19*a* is rendered to be ON level, and the memory control signal line 19*b* is rendered to be OFF level, thus turning on only the second switching element 21. Then, a clock signal, a start signal and dynamic image data are supplied to the scan driver 120 and the data driver 130, respectively, and the liquid crystal display apparatus 100 is driven similarly to an ordinary active matrix type liquid crystal display apparatus, whereby a half-tone/dynamic image displaying by full-color image can be performed with high image quality.

As described above, when the liquid crystal display apparatus 100 is driven so as to turn on only the second switching element 21 during the normal displaying, the charges of the dynamic image data written to the pixel electrode 13 are partially retained also in the second capacitor element 25. Therefore, the charged charges in the first capacitor element 24 can be retained more stably. Note that it is also possible to drive the liquid crystal display apparatus 100 so that both of the memory control signal lines 19*a* and 19*b* are rendered to be OFF level and both of the second and third switching elements 21 and 22 are turned off during the normal displaying. In this case, the charges of the dynamic data written to the pixel electrode 13 are retained in the liquid crystal layer 16 and the first capacitor element 24.

Subsequently, a method of driving the liquid crystal display apparatus during the still image displaying will be described with reference to the timing chart of the signal waveform shown in FIG. 4. In this example, a DC High power source voltage and a DC Low power source voltage are supplied to the power source wirings 28*a* and 28*b*, respectively.

In a still image writing frame that is the first frame of the still image displaying, the memory control signal line 19*a* is rendered to be ON level, and the memory control signal line 19*b* is rendered to be OFF level, thus turning on only the second switching element 21. Then, while the first switching element 14 is being turned on by a row selection signal, the still image data is sampled on the signal line 11, and the sampled still image data is written from the first switching element 14 to the DM cell 18 through the second switching element 21 of the DM switching circuit 17.

When the first switching element 14 is turned off after the still image data is written to the DM cell 18, the still image data is retained in the second capacitor element 25 of the DM cell 18 and the inverter circuit 23 thereof (hereinafter abbreviated to "the still image data is retained in the second capacitor element 25 of the DM cell 18").

When the still image data written to the DM cell 18 is retained for a long time during the period of the still image displaying, the liquid crystal layer 16 is deteriorated by DC components, and hence the liquid crystal display apparatus 100 must be AC-driven. In this embodiment, the AC-driving is realized in that at a certain cycle the memory control signal of ON level is alternately supplied to the memory control signal lines 19*a* and 19*b*, and the second and third switching elements 21 and 22 are alternately turned on. At the same time, a potential at the opposite electrode 15 is inverted.

Specifically, in each frame of the still image display period, the memory control signal line 19*b* is first rendered to be ON level, and the third switching element 22 is turned on, whereby the still image data retained in the second capacitor element 25 is written to the pixel electrode 13. During this period, the memory control signal line 19*a* is made to be OFF level. Subsequently, the memory control signal line 19*a* is rendered to be ON level and the second switching element 21 is turned on just before termination of one frame, whereby the second capacitor element 25 is again allowed to retain the still image data written to the pixel electrode 13. Meanwhile, the memory control signal line 19*b* is rendered to be OFF level. When such an operation is repeated alternately every one frame, the still image data is subjected to polarity inversion by the inversion circuit 23 and written to the pixel electrode 13 every time the still image data is fetched from the second capacitor element 25. Therefore, polarity inversion driving can be performed by inverting the potential of the opposite electrode 15 in accordance with this cycle.

Figure 4:
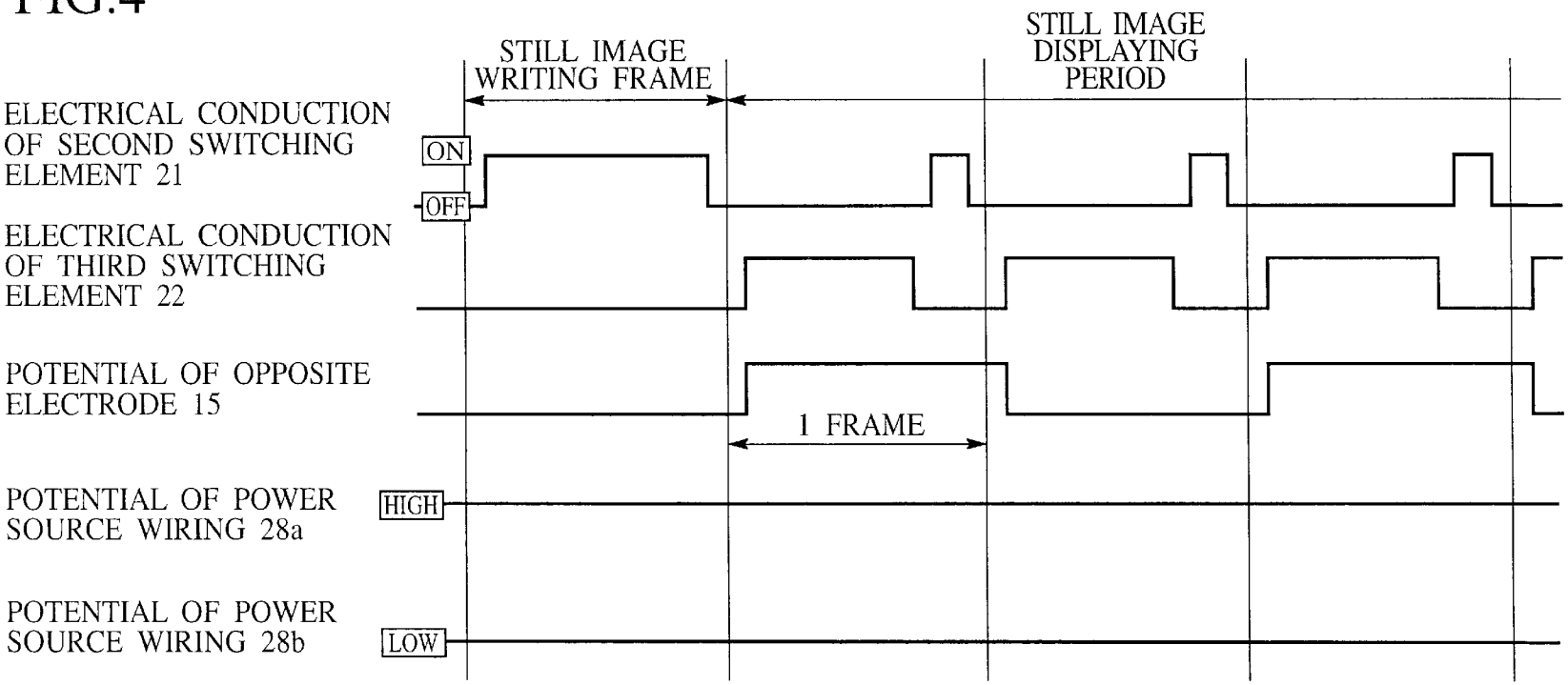
FIG. 4 is a timing chart for explaining a driving method in performing a still image displaying.

Furthermore, in order to enable the liquid crystal display apparatus 100 to perform such an operation, as shown in FIG. 4, ON time of the third switching element 22 is set to be longer than that of the second switching element 21 during the still image display period. In this embodiment, the ON time of the second switching element 21 is set to be about 1/10 as long as that of the third switching element 22. Note that the ON time of the third switching element 22 can be set appropriately depending on design conditions of the liquid crystal panel.

As described above, when the second and third switching elements 21 and 22 are alternately turned on every one frame, potentials showing a High power source voltage and a Low power source voltage are alternately output to the pixel electrode 13. When the potential of the opposite electrode 15 is shifted with the potential equivalent to the High power source voltage and the Low power source voltage in synchronization with the outputs, a voltage is not applied to a liquid crystal layer 16 in a display pixel 10 having the same polarity as that of the opposite electrode 15, and a voltage is applied to a liquid crystal layer 16 in a display pixel 10 having the opposite polarity to that of the opposite electrode 15. Accordingly, a state where the voltage is applied to the liquid crystal layer 16 and a state where the voltage is not applied to the liquid crystal layer 16 are respectively made to correspond to a white image and a black image, whereby it is possible to perform monochrome image displaying. At this time, since the memory control line 19 of a low frequency and the opposite electrode 15 alone operate in the display pixel section 110, the still image displaying can be performed with low power consumption. Furthermore, during the period, since the supply of the potential to the pixel electrode 13 is done from the DM cell 18, a potential of the auxiliary capacitance Cs formed between the first capacitor element 24 and the auxiliary capacitance line (not shown) is irrelevant to the image displaying. Therefore, a potential lower than an auxiliary capacitance potential applied to the first capacitor element 24 can be supplied to the foregoing auxiliary capacitance line in the normal displaying, and low power consumption can be achieved, Though illustrations are not made in FIG. 4, when the displaying is switched from the still image displaying to the normal displaying, the memory control signal lines 19*a* and 19*b* are again rendered to be OFF level or only the memory control signal line 19*b* is rendered to be OFF level after a still image final frame. Then, a clock signal, a start signal and a dynamic image data are supplied to the scan driver 120 and the data driver 130, respectively.

Figure 5:
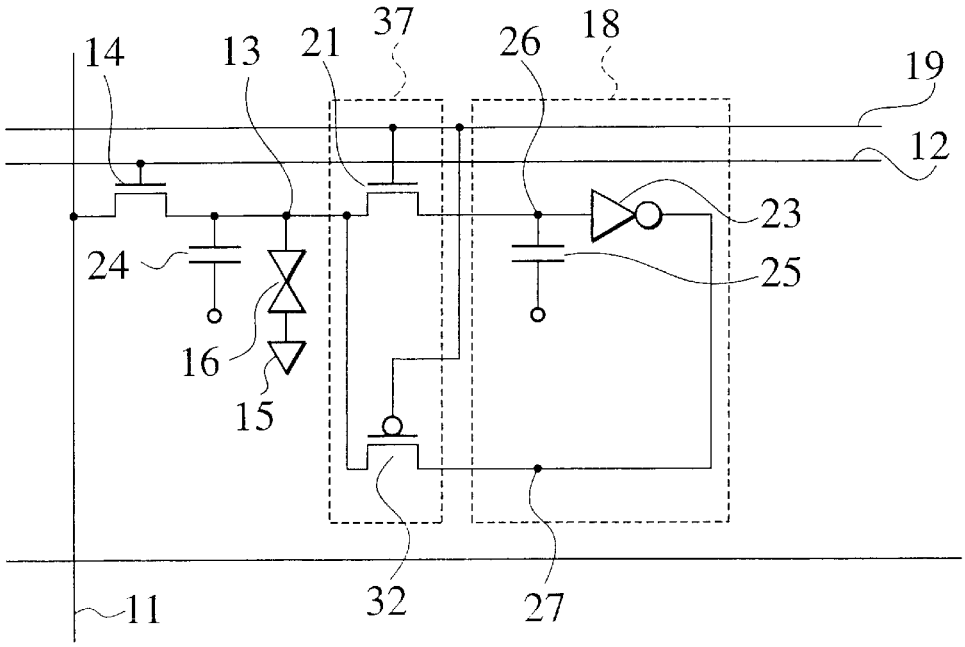
FIG. 5 is a circuit diagram showing another embodiment of the display pixel shown in FIG. 3.

Next, another embodiment of the DM switching circuit 17 will be described. FIG. 5 is a circuit diagram showing another embodiment of the display pixel 10 shown in FIG. 3. In FIG. 5, the same or equivalent constituent components to those in FIG. 3 are denoted by the same reference numerals.

The DM switching circuit 37 of this embodiment is constituted by the second switching element 21 formed of an N-channel TFT and the third switching element 32 formed of a P-channel TFT. A gate electrode of each switching element is connected to the common memory control signal line 19, and turning ON/OFF of the second and third switching elements 21 and 32 are simultaneously controlled by a memory control signal supplied from the memory control signal line 19. Specifically, in the DM switching circuit 37 shown in FIG. 5, when the second switching element 21 is turned on, the third switching element 32 is turned off. When second switching element 21 is turned off, the third switching element 32 is turned on.

In the normal displaying, in the case where the second switching element 21 is turned on and the second capacitor element 25 is charged with charges of the dynamic image data, it is unnecessary to turn off the two switching elements simultaneously. Therefore, by adopting the circuit constitution as shown in FIG. 5, the number of the memory control signal lines 19 can be reduced to half of that of the circuit constitution of the FIG. 3.

Note that the N-channel TFT constituting the second switching element 21 and P-channel TFT constituting the third switching element 32 are field effect transistors, each of which has a different conductivity type from the other in this embodiment. In this embodiment, the second and third switching elements 21 and 32 are composed of a CMOS transistor.

Next, a concrete circuit constitution of the DM cell 18 will be described. Herein, the circuit constitution of FIG. 5 is described as an example. Moreover, another method of driving the liquid crystal display apparatus in performing the still image displaying will be also described.

Figure 6:
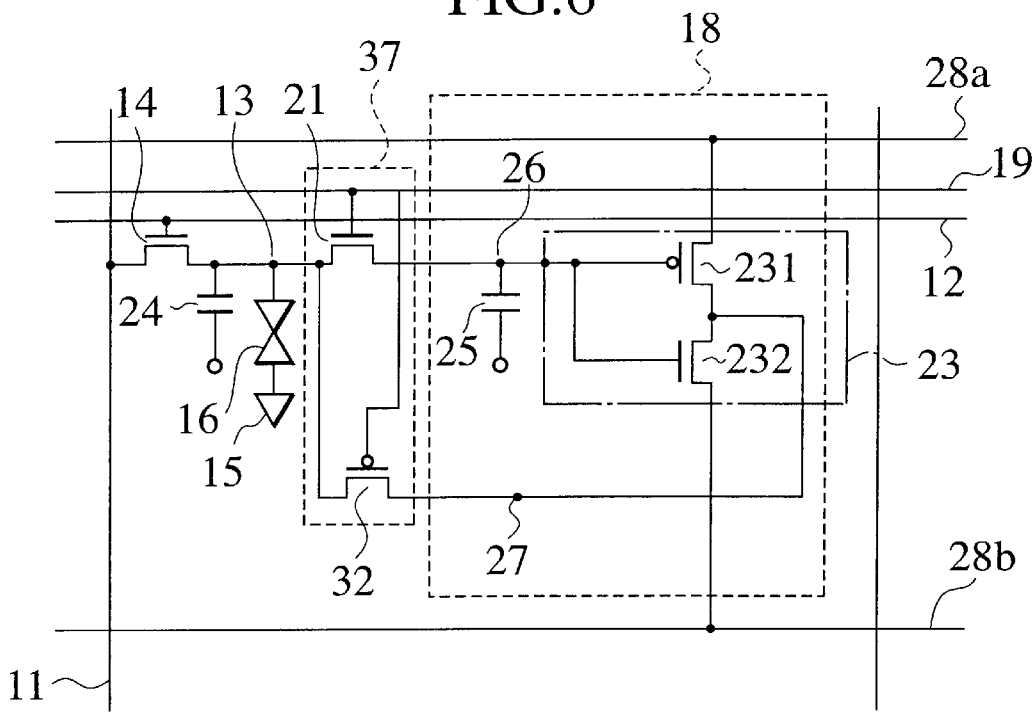
FIG. 6 is a detailed circuit diagram of the display pixel shown in FIG. 5.

FIG. 6 is a detailed circuit diagram of the display pixel 10 shown in FIG. 5. In FIG. 6, the same and equivalent constituent components to those in FIG. 5 are denoted by the same reference numerals.

The inverter circuit 23 included in the DM cell 18 is composed of the P-channel TFT 231 and the N-channel TFT 232, which are in series connected to each other. The power source wiring 28*a* is connected to the P-channel TFT 231 serving as a positive polarity side, and the power source wiring 28*b* is connected to the N-channel TFT 232 serving as a negative polarity side.

Figure 7:
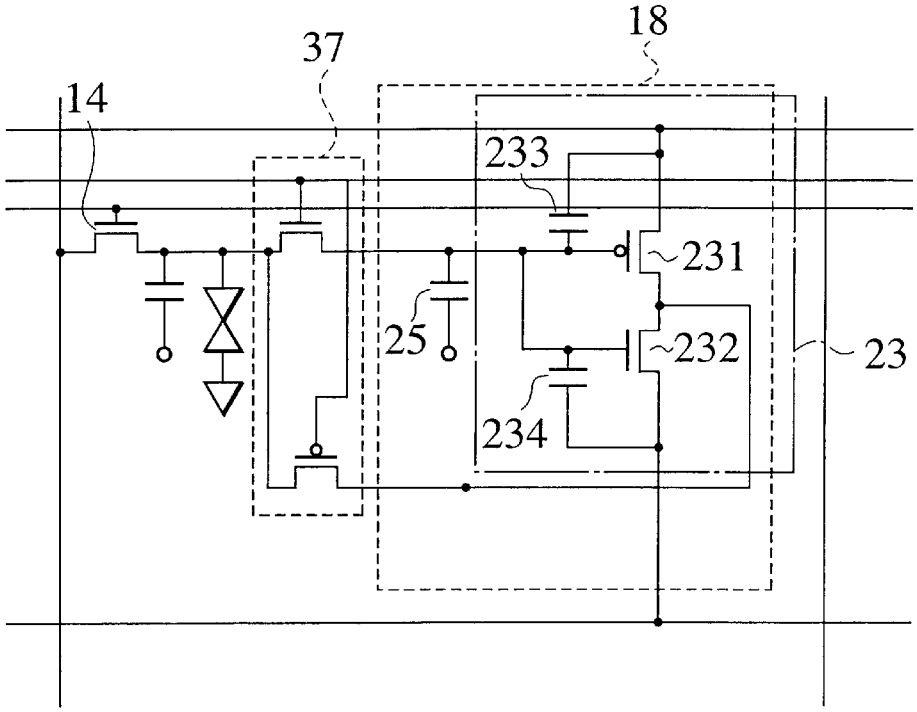
FIG. 7 is a circuit diagram when a capacitor element is added to an inverter circuit of FIG. 6.

When the charged charges of the still image data written to the inverter circuit 23 cannot be stably retained by the second capacitor element 25, the third capacitor element 233 and the fourth capacitor element 234 are respectively added to the P-channel TFT 231 and the N-channel TFT 232, as shown in FIG. 7. In FIG. 7, the third capacitor element 233 is connected between the gate electrode of the P-channel TFT 231 and the power source wiring 28*a,* and the fourth capacitor element 234 is connected between the gate electrode of the N-channel TFT 232 and the power source wiring 28*b.* With the adoption of such a circuit constitution, the charged charges can be retained more stably.

Also in this case, in the case where the liquid crystal display apparatus is driven so that the second switching element 21 alone is turned on in the normal displaying, the first and second capacitor elements 24 and 25 are electrically conducted, and, at the same time, the third and fourth capacitor elements 233 and 234 are electrically conducted, the charges of the dynamic image data written to the pixel electrode 13 can be partially retained in the three capacitor elements 25, 233 and 234 of the DM cell 18. Accordingly, if a capacitor required for the normal displaying is formed by combining the capacitance of the first capacitor element 24 with the capacitances of the three capacitor elements of the DM cell 18, it is possible to decrease the capacitance of the first capacitor element 24 by an amount equivalent to the capacitances of the three capacitor elements of the DM cell 18. Thus, a circuit area on the substrate can be made smaller, and hence microfabrication of the liquid crystal display apparatus and an increase in a manufacturing yield can be achieved.

Next, in the circuit constitution shown in FIG. 6, a method of driving the liquid crystal display apparatus in performing the normal displaying and the still image displaying will be described. Note that since a method of driving the liquid crystal display apparatus in performing the normal displaying is the same as that of the foregoing embodiments, only a method of driving the same in performing the still image displaying is herein described.

Figure 8:
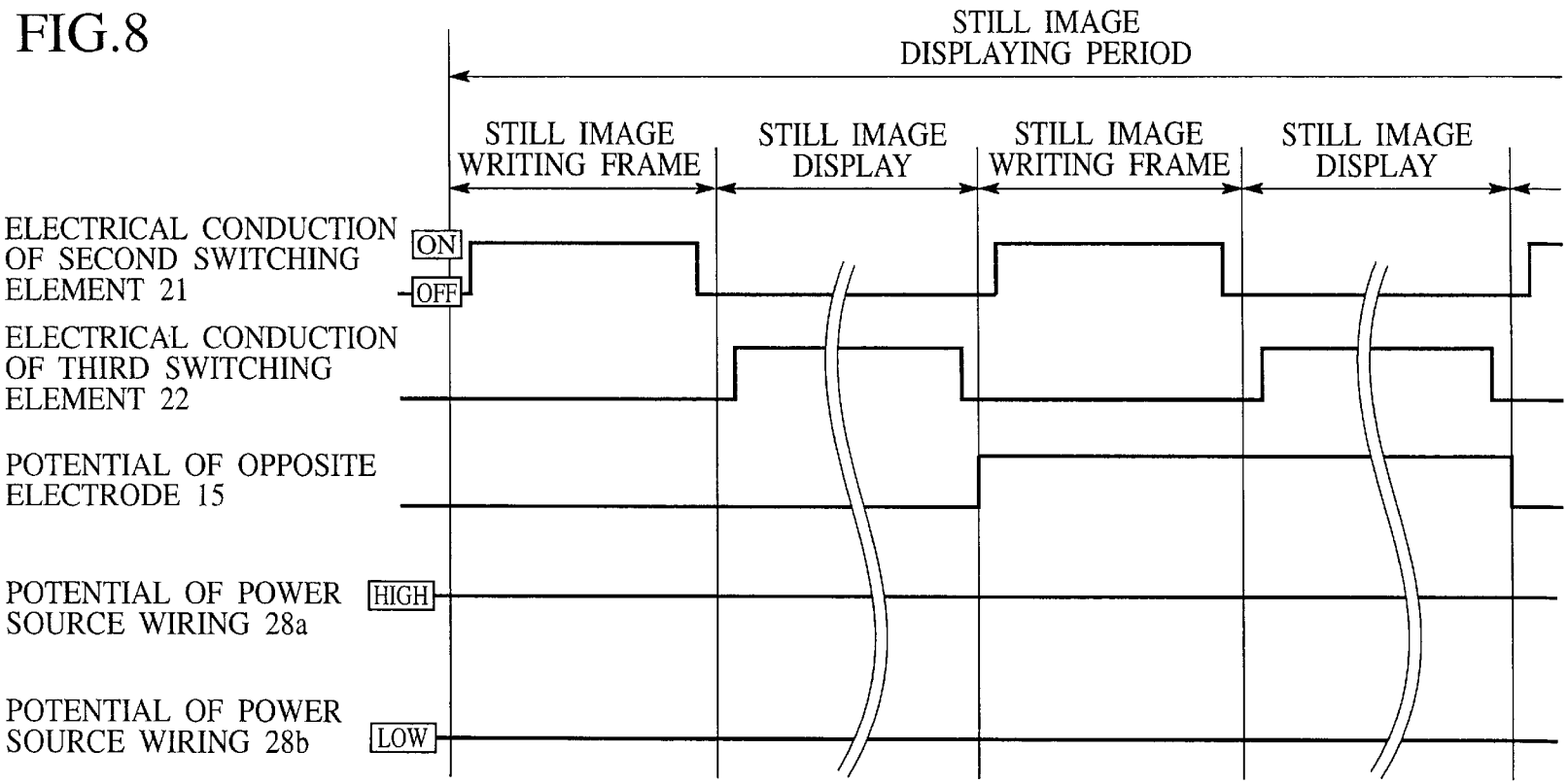
FIG. 8 is a timing chart of a signal waveform showing another driving method in performing the still image displaying.

FIG. 8 is a timing chart of a signal waveform showing another method of driving the liquid crystal display apparatus in performing the still image displaying. In this example, a DC High power source voltage and a DC Low power source voltage are supplied to the power source wirings 28*a* and 28*b,* respectively.

In the driving method of this embodiment, writing of the still image data is performed every several frames during the still image displaying period. Specifically, in the still image writing frame, the memory control signal line 19 is rendered to be ON level, and the second switching element 21 alone is turned on. Then, while the first switching element 14 is being turned on by the row selection signal, the still image data is sampled on the signal line 11, and the sampled still image data is written to the DM cell 18 from the first switching element 14 through the second switching element 21 of the DM switching circuit 17. Then, when the first switching element 14 is turned off, the still image data is retained in the second capacitor element 25 of the DM cell 18.

Thereafter, the still image displaying is performed by the still image data written to the DM cell 18. The still image writing frame is provided once for each group of a predetermined number of frames, and writing of the still image data is performed. The still image data written at this time has an opposite polarity to that of the image data written in the last still image writing frame, and a polarity inversion driving can be performed by inverting the potential of the opposite electrode 15 in accordance with the polarity of this still image data.

In the still image displaying period in this embodiment, the still image data having the same polarity is supplied to the liquid crystal layer 16 during a period for a predetermined number of frames until a new still image data is written to the DM cell 18. Accordingly, it is unnecessary to drive the memory control signal line 19 during this period. On the other hand, the scan driver 120 and the data driver 130 are driven for each group of a predetermined number of frames. However, according to a simulation by the inventors of this application, compared to the driving method shown in FIG. 4, it is confirmed that the liquid crystal display apparatus can be driven with lower power consumption during the still image displaying period. Note that since the potential of the still image data written to the DM cell 18 is decreased with a passage of time, the number of the frames in the still image displaying is set within a period in which the still image data can retain the potential required to drive the liquid crystal.

Figure 9:
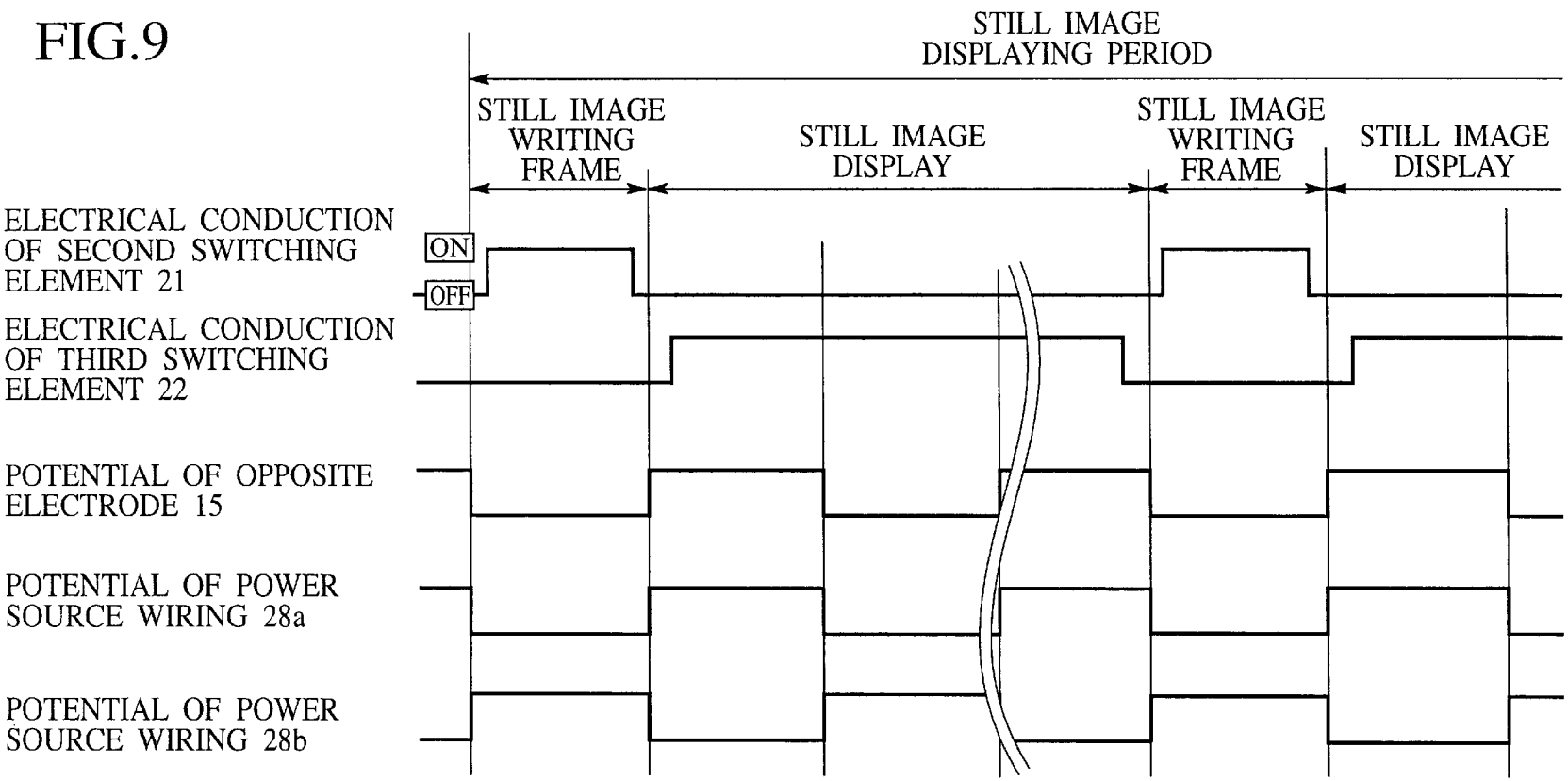
FIG. 9 is a timing chart of a signal waveform showing still another driving method in performing the still image displaying.

FIG. 9 is a timing chart of a signal waveform showing still another driving method in performing the still image displaying. In this example, AC power source voltages (alternate potential of High level/Low level) are supplied to the power source wirings 28*a* and 28*b.*

In the driving method of this embodiment, writing of the still image data is performed for each several frames during the still image displaying period similarly to the embodiment shown in FIG. 8. This driving method of this embodiment is different from the diving method shown in FIG. 8 in that the polarity inversion driving is performed every one frame. Specifically, the potentials of the power source wirings 28*a* and 28*b* are inverted every one frame during the still image displaying period by the still image data written to the DM cell 18, and the potential of the opposite electrode 15 is inverted in response to this cycle. The driving method of this embodiment will be described with reference to FIG. 6 and FIG. 9 below.

During the still image displaying period, the memory control signal line 19 is rendered to be OFF level, the second switching element 21 is turned off, and the third switching element 32 is turned on. On the other hand, in accordance with the potential of the still image data retained in the second capacitor element 25, one of the P- and N-channel TFTs 231 and 232 of the inverter circuit 23 is turned on. The potential of this still image data is equal to that of the still image data written to the display pixel, and binary information having High or Low level.

When one of the P- and N-channel TFTs 231 and 232 of the inverter circuit 23 is turned on, the potential of the still image data written to the DM cell 18 is written to the pixel electrode 13 from one of the P- and N-channel TFTs 231 and 232 through the output terminal 27 and the third switching element 23. Accordingly, in a certain frame, if a potential of the still image data is High level, the N-channel TFT 232 is turned on, and a potential of Low level is supplied to the pixel electrode 13 from the power source wring 28*b* through the third switching element 23. At this time, since the opposite electrode 15 shows an opposite potential to that of the pixel electrode 13, a voltage is applied to the liquid crystal layer 16. Furthermore, in the same frame, if the potential of the still image data is Low level, the P-channel TFT 231 is turned on, and a potential of High level is supplied to the pixel electrode 13 from the power source wiling 28*a* through the third switching element 23. At this time, since the opposite electrode 15 shows an equal potential to that of the pixel electrode 13, a voltage is not applied to the liquid crystal layer 16. Accordingly, it is possible to perform image displaying by black and white color, by respectively allowing the state where the voltage is applied to the liquid crystal layer 16 and the state where the voltage is not applied to the liquid crystal layer 16 to correspond to a white color image and a black color image.

Also in the case where the polarity of the power source voltage supplied to the power source wirings 28*a* and 28*b* is inverted in the next frame, the potential of the still image data supplied to the pixel electrode 13 and the potential of the opposite electrode 15 are inverted to the other. Accordingly, the same effect as that described above is obtained. As described above, the potentials of the power source wirings 28*a* and 28*b* are inverted every one frame, and the potential of the opposite electrode 15 is inverted in response to this cycle, whereby it is possible to perform the polarity inversion driving in the still image displaying over the predetermined number of frames.

Figure 10:
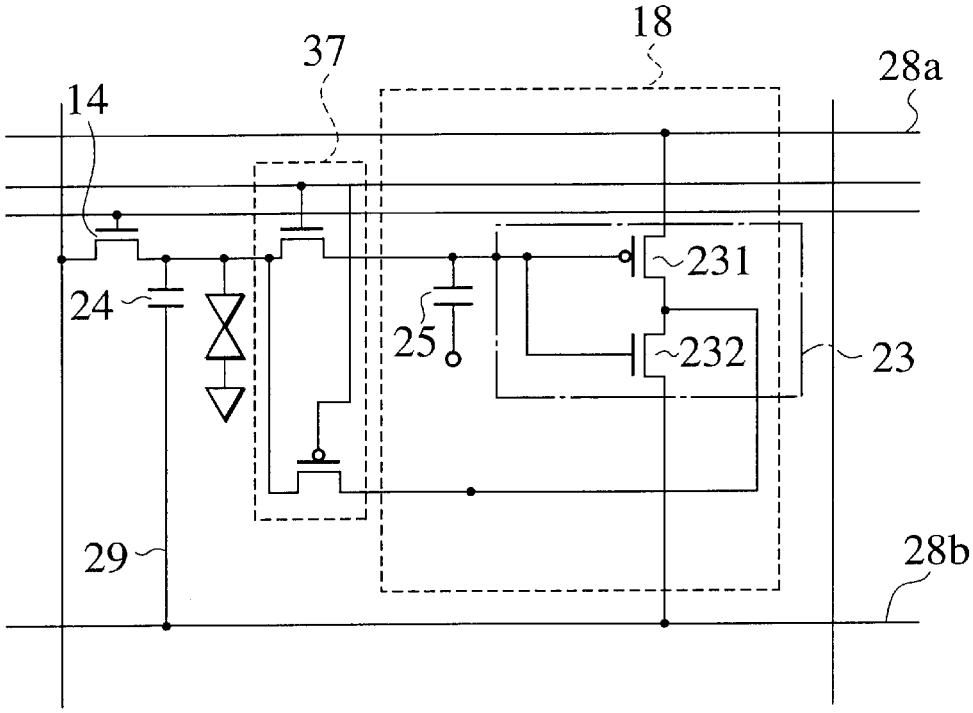
FIG. 10 is a circuit diagram in the case where an auxiliary capacitance line of FIG. 6 and a power source wiring of the inverter circuit of FIG. 6 are shared.
Figure 11:
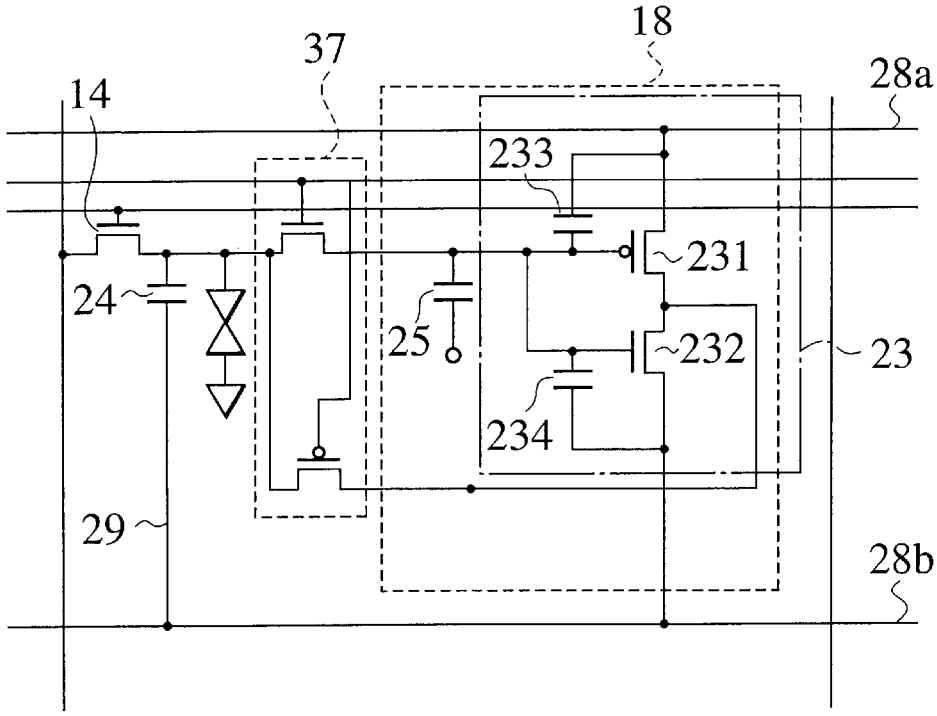
FIG. 11 is a circuit diagram in the case where an auxiliary capacitance line of FIG. 7 and a power source wiring of the inverter circuit of FIG. 7 are shared.

Note that the power source wiring for supplying the auxiliary capacitance potential to the first capacitor element 24 and the power source wiring of the inverter circuit 23 can be also shared. The circuit constitution in this case is shown in FIG. 10 and FIG. 11. FIG. 10 corresponds to FIG. 6, and FIG. 11 corresponds to FIG. 7. In FIG. 10 and FIG. 11, the circuit constitution in which the power source wiring 28*b* and the auxiliary capacitance line 29 that is a power source wiring of the first capacitor element 24 are shared is shown. Note that the circuit constitution in which the auxiliary capacitance line 29 and the power source wiring 28*b* are share may be adopted. As shown in FIG. 10 and FIG. 11, when the auxiliary capacitance line 29 and one of the power source wirings 28*a* and 28*b* of the inverter circuit 23 are shared, it is unnecessary to provide the power source wirings individually on the substrate, and hence the number of the wirings on the substrate can be reduced. Accordingly, a pixel pitch can be further narrowed than the conventional, and it is possible to achieve a microfabrication of a screen. Furthermore, occurrence of short malfunctions between the wirings can be lessened by reducing the number of the wirings, and an increase in a manufacturing yield can be achieved.

Next, a method of fabricating the liquid crystal display apparatus 100 according to the embodiment will be described by use of FIG. 12. FIGS. 12A to 12F are schematic section views showing fabrication processes of the liquid crystal display apparatus. The area on the right side of the drawings shows the pixel portion corresponding to the display pixel section 110, and the area on the left side of the drawings shows the driving circuit portion corresponding to the scan line driving section 120 and the like of FIG. 1. The fabrication processes will be described in the order of the items (1) to (6) below.

Figure 12A:
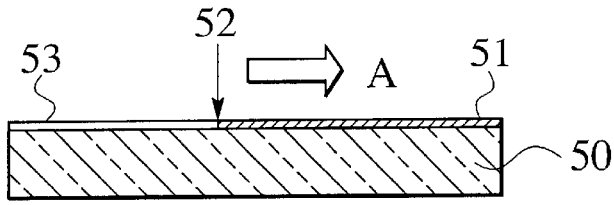
FIGS. 12A to 12F are schematic section views showing manufacturing processes of the liquid crystal display apparatus.

(1) Formation of Polycrystalline Silicon Film (see FIG. 12A)

The amorphous silicon (a-Si) thin film 51 having a thickness of 50 nm is deposited on the transparent insulating substrate 50 formed of glass or the like by use of a plasma CVD method. Subsequently, the amorphous silicon thin film 51 is polycrystallized by annealing the amorphous silicon thin film 51 by use of an XeCl excimer laser apparatus (not shown). Herein, the laser beam 52 from the XeCl excimer laser apparatus is scanned in the direction of the arrow A, and the area onto which the laser beam 52 is irradiated is crystallized and becomes polycrystalline silicon film 53. At this time, when the irradiation of the laser beam 52 is performed plural times while elevating laser irradiation energy stepwise, hydrogen in the amorphous silicon film can be effectively drawn to the outside, so that ablation in crystallizing the amorphous silicon thin film 51 can be prevented. Note that the laser irradiation energy should preferably be set to a range of 200 to 500 mJ/cm$^2$.

Figure 12B:
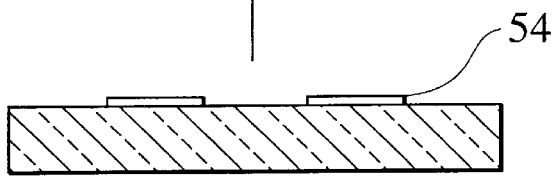

(2) Patterning (see FIG. 12B)

The polycrystalline silicon film 53 is patterned by use of a photolithography method, and the activation films 54 of the thin film transistors are formed.

Figure 12C:
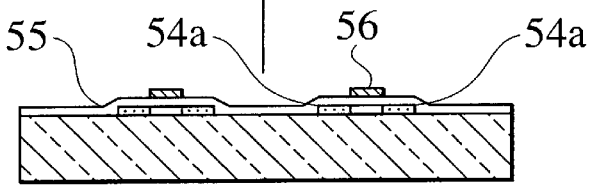

(3) Formation of Gate Electrode (see FIG. 12C)

After the gate insulating film 55 formed of a silicon oxide film is formed by use of a plasma CVD method, a molybdenum-tungsten alloy film is formed by use of a sputtering method, and then patterned. Thus, the gate electrodes 56 of the thin film transistors are formed. At the same time, scan lines are also formed in patterning the molybdenum-tungsten alloy film. As the gate insulating film 55, a silicon nitride film and a silicon oxide film formed by use of a normal pressure CVD method can be used besides.

After the formation of the gate electrodes 56, impurities are ion-implanted by use of an ion-doping method while using the gate electrodes 56 as a mask, and source/drain regions 54*a* of the thin film transistors are formed. As the impurities, phosphorus can be used for an N-channel transistor, and boron can be used for a P-channel transistor. A LDD (lightly doped drain) structure is effectively used for transistors of the pixel section, in order to suppress leak current when the transistors are turned off. In this case, after the impurity injection to the source/drain regions 54*a*, each gate electrode 56 is patterned again to decrease its size to a certain degree. Then, implantation of a low impurity concentration is performed again.

Figure 12D:
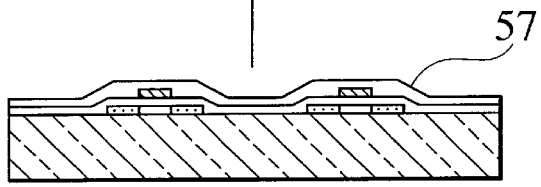

(4) Formation of First Interlayer Insulating Film (see FIG. 12D)

A first interlayer insulating film 57 formed of a silicon oxide film is formed on the gate electrodes 56 by use of the plasma CVD method or the normal pressure CVD method.

Figure 12E:
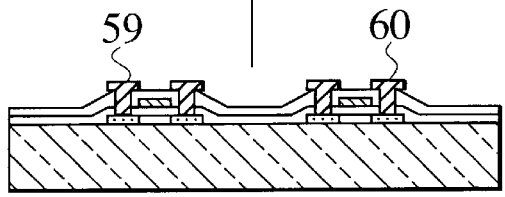

(5) Formation of Source/Drain Electrodes (see FIG. 12E)

Contact holes are formed in the first interlayer insulating film 57 and the gate insulating film 55, and then an Al film is formed by use of the sputtering method. The source/drain electrodes 59 and 60 are formed by patterning the Al film. At this time, signal lines are also formed simultaneously with the formation of the source/drain electrodes 59 and 60.

Figure 12F:
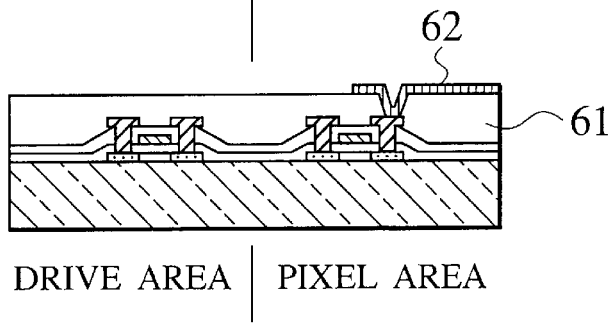

(6) Formation of Pixel Electrode (see FIG. 12F)

The low dielectric constant insulating film (second interlayer insulating film) 61 is formed on the Al film. As the low dielectric constant insulating film 61, a low dielectric constant insulating film such as a silicon nitride film, a silicon oxide film and an organic insulating film, which are formed by use of the plasma CVD method, can be used. Then, contact holes are formed in the low dielectric constant insulating film 61, and, at the same time, the Al thin film 62 is formed. The Al thin film 62 is patterned, thus forming the pixel electrode.

The pixel section and the driving circuit section can be formed integrally on the transparent insulating substrate 50 by the above described process performed in the six stages. Thereafter, the transparent insulating substrate 50 and an opposite substrate in which an opposite electrode (not shown) are formed are allowed to face each other, and the circumferences of the transparent insulating substrate 50 and the opposite substrate are sealed with a sealing member formed of epoxy resin. Liquid crystal compound is injected thereinto, and sealed therein. Thus, the liquid crystal display apparatus is completed (see FIG. 2).

Since a p-Si (polysilicon) TFT shows an electron mobility higher than an a-Si TFT by about two digits, it is possible to reduce the size of the TFT, and a peripheral driving circuit can be formed simultaneously integrally with the pixel section and the driving circuit section on the substrate. As the peripheral driving circuit, a CMOS structure should preferably be adopted to achieve a high-speed operation and low power consumption. Therefore, the foregoing impurity doping step is performed in such a manner that a P-type impurity doping step and an N-type doping step are respectively performed dividedly using a resist mask.

When the light reflection type pixel electrode in which the pixel electrode 13 is constituted by the metallic thin film is adopted as this embodiment, a backlight is unnecessary. Accordingly, it is possible to drive the liquid crystal display apparatus with lower power consumption compared to the transmission type constitution using the backlight. Incidentally, when the still image displaying for a liquid crystal panel of 5 cm square and 250000 pixels was performed at a frame frequency of 60 Hz, power consumption could be suppressed to 5 mW.

In the foregoing embodiments, the examples in which the present invention was applied to the liquid crystal display apparatus were described. However, the display layer that is one of the constituent components of the present invention is not limited to the liquid crystal layer, but the display layer can be substituted by layers formed of other materials. For example, a fluorescent light emission layer can be used as the display layer. In this case, the present invention can be constituted as an organic EL (electro luminescence) panel.

As described above, the embodiments relating to the display apparatus and the method of driving the same according to the present invention were described. The present invention is not limited to the above embodiments, and various modifications and alternations can be embodied without departing from the scope of the invention. Moreover, in the foregoing embodiments, the inventions in various stages are involved, and various inventions can be extracted by combining the disclosed constituent components properly. For example, even if some constituent components are deleted from the disclosed ones, the combinations of these constituent components can be extracted as the invention as long as a predetermined effect can be obtained therefrom.

What is claimed is:

1. A display apparatus, comprising:

a first electrode substrate comprising:

a plurality of scan lines and a plurality of signal lines arranged so as to intersect with each other, pixel electrodes, each being arranged at corresponding one of crossing points of said plurality of scanning and signal lines, first capacitor elements, each being electrically connected in parallel to corresponding one of said pixel electrodes, and first switching elements configured to electrically connect said plurality of signal lines to said pixel electrodes, each directly connecting a corresponding signal line to a pixel electrode and, each being turned ON/OFF by a row selection signal supplied to the corresponding one of said scan lines, and when turned ON, allowing said signal line and said pixel electrode to be electrically connected, thus writing video data supplied to said signal line to said pixel electrode;

a second electrode substrate having opposite electrodes, oppositely disposed so as to face said pixel electrodes with a predetermined gap therebetween;

a display layer sandwiched between said first and second electrode substrates;

a data driver configured to supply the video data to said plurality of signal lines in response to one horizontal scanning period; and a scan driver configured to sequentially supply the row selection signal to the corresponding one of said scan lines every said one horizontal scanning period, wherein said first electrode substrate has:

a digital memory cell comprising an inverter circuit capable of retaining the video data supplied to said signal line; and a digital memory switching circuit inserted between the corresponding pixel electrode and said digital memory cell and configured to control an electrical connection between said pixel electrode and said digital memory cell.

2. The display apparatus according to claim 1, wherein said inverter circuit comprises a CMOS circuit.

3. The display apparatus according to claim 2, wherein third and fourth capacitor elements are connected to the CMOS circuit comprising said inverter circuit.

4. The display apparatus according to claim 1, wherein said pixel electrode is a light reflection type pixel electrode comprising a metallic thin film.

5. The display apparatus according to claim 1, wherein said digital memory switching circuit comprises a second switching element connected to an input terminal of said digital memory cell, and a third switching element connected to an output terminal of said digital memory cell.

6. The display apparatus according to claim 5, wherein said second and third switching elements comprise field effect transistors of the same conductivity type, which are respectively connected to different control signal lines.

7. The display apparatus according to claim 5, wherein said second and third switching elements comprise field effect transistors of conductivity types different from each other, which are connected to a common control signal line.

8. The display apparatus according to claim 1, wherein one of power source wirings of said digital memory cell and a power source wiring for supplying a predetermined voltage to said first capacitor element are shared.

9. The display apparatus according to claim 1, wherein said display layer is a liquid crystal layer.

10. The display apparatus according to claim 1, wherein said digital memory cell is composed of one inverter circuit and a second capacitor element.

11. The display apparatus according to claim 10, wherein said digital memory switching circuit comprises a second switching element connected to an input terminal of said digital memory cell, and a third switching element connected to an output terminal of said digital memory cell, and said second capacitor element is connected between said second switching element and said inverter circuit.

12. The display apparatus according to claim 1, wherein during a first displaying period, said pixel electrode and said digital memory cell are not electrically conducted by said digital memory switching circuit, and said first switching element is turned on at a predetermined cycle, thus performing displaying by writing first video data supplied to said signal line to said pixel electrode; and during a second displaying period, said pixel electrode and said digital memory cell are electrically conducted by said digital memory switching circuit, said digital memory cell is allowed to retain second video data therein supplied to said signal lines, and then said signal lines and said pixel electrode are not electrically conducted by said first switching element, thus performing displaying by writing the second video data retained in said digital memory cell to said pixel electrode.

13. A method of driving the display apparatus according to claim 12, comprising:

during said first displaying period, making said second switching element alone and said pixel electrode alone electrically conductive in said digital memory switching circuit.

14. The method of driving the display apparatus according to claim 12, comprising:

during said second displaying period, making said second and third switching elements alternately conductive every one frame, supplying the second video data of a different polarity from said digital memory cell to said pixel electrode every one frame, and inverting a potential of said opposite electrode is inverted in response to a cycle of one frame.

15. The method of driving the display apparatus according to claim 14, comprising:

during said second displaying period, making a turning-on time of said third switching element is made to be longer than that of said second switching element.

16. The method of driving the display apparatus according to claim 14, comprising:

supplying a DC power source voltage to said digital memory cell.

17. The method of driving the display apparatus according to claim 12, comprising:

during said second displaying period, making said pixel electrode and said digital memory cell electrically conductive by said digital memory switching circuit for each group of a predetermined number of frames, allowing said digital memory cell to retain the second video data therein supplied to said signal lines, and then disabling said signal lines and said pixel electrode electrically by said first switching element, thus performing displaying for each group of a predetermined number of frames by writing the second video data retained in said digital memory cell to said pixel electrode.

18. The method of driving the display apparatus according to claim 17, comprising:

during said second displaying period, allowing said digital memory cell to retain the second video data of a different polarity for a predetermined number of frames, and inverting a potential of said opposite electrode in response to a cycle of the predetermined number of frames.

19. The method of driving the display apparatus according to claim 17, comprising:

supplying a DC power source voltage to said digital memory cell.

20. The method of driving the display apparatus according to claim 17, comprising:

supplying an AC power source voltage to said digital memory cell, and inverting a potential of said opposite electrode in response to a cycle of the AC power source voltage.

21. A display apparatus, comprising:

a first electrode substrate comprising:

a plurality of scan lines and a plurality of signal lines arranged so as to intersect with each other, pixel electrodes, each being arranged at corresponding one of crossing points of said plurality of scanning and signal lines, first capacitor elements, each being electrically connected in parallel to corresponding one of said pixel electrodes, and first switching elements, each connecting a corresponding signal line to a pixel electrode and, each being turned ON/OFF by a row selection signal supplied to the corresponding one of said scan lines, and when turned ON, allowing said signal line and said pixel electrode to be electrically connected, thus writing video data supplied to said signal line to said pixel electrode;

a second electrode substrate having opposite electrodes, oppositely disposed so as to face said pixel electrodes with a predetermined gap therebetween;

a display layer sandwiched between said first and second electrode substrates;

a data driver configured to supply the video data to said plurality of signal lines in response to one horizontal scanning period; and a scan driver configured to sequentially supply the row selection signal to the corresponding one of said scan lines every said one horizontal scanning period, wherein said first electrode substrate has:

a digital memory cell comprising an inverter circuit capable of retaining the video data supplied to said signal line; and a digital memory switching circuit inserted between the corresponding pixel electrode and said digital memory cell and configured to control an electrical connection between said pixel electrode and said digital memory cell, wherein said digital memory cell is composed of one inverter circuit and a second capacitor element.

* * * * *